United States Patent [19]

Kanzaka

[11] 4,202,285

[45] May 13, 1980

[54] PRESSER FOOT FOR CONCEALED SLIDE FASTENERS

[75] Inventor: Yoshihiro Kanzaka, Nyuzen, Japan

[73] Assignee: Yoshida-Kogyo K.K., Tokyo, Japan

[21] Appl. No.: 941,284

[22] Filed: Sep. 11, 1978

[30] Foreign Application Priority Data

Sep. 20, 1977 [JP] Japan ..... 52-126709

[51] Int. Cl.[2] ..... D05B 29/00

[52] U.S. Cl. ..... 112/235

[58] Field of Search ..... 112/235, 240, 60

[56] References Cited

U.S. PATENT DOCUMENTS

| | | | |
|---|---|---|---|
| 3,473,498 | 10/1969 | Howell | 112/240 |
| 3,492,960 | 2/1970 | Fujisaki | 112/235 |
| 3,735,718 | 5/1973 | Vizgirda et al. | 112/235 |
| 3,858,539 | 1/1975 | Van Amburg | 112/235 |
| 3,901,170 | 8/1975 | Takamatsu | 112/235 |

FOREIGN PATENT DOCUMENTS

| | | | |
|---|---|---|---|
| 364975 | 11/1962 | Switzerland | 112/235 |
| 846876 | 8/1960 | United Kingdom | 112/235 |

*Primary Examiner*—Wm. Carter Reynolds

*Attorney, Agent, or Firm*—Bucknam and Archer

[57] ABSTRACT

A presser foot adapted to be attached to a sewing machine for sewing a concealed type of sliding clasp fastener to a garment fabric or the like, the foot having in its sole or bottom surface a pair of spaced guide grooves. A substantially V-shaped partition is disposed longitudinally centrally of the foot and separates the guide grooves. This partition has an integral projection extending downwardly to register with the bottom surface of the foot and laterally beyond both sides of the partition whereby the folded edge of the concealed fastener is retained in unfolded disposition at the initial stage of sewing operation.

2 Claims, 5 Drawing Figures

PRESSER FOOT FOR CONCEALED SLIDE FASTENERS

BACKGROUND OF THE INVENTION

1. Field of the Invention

This invention relates to a presser foot for use in sewing a slide fastener to a garment or the like, and more particularly to such a presser foot which is suitable for attaching a concealed type of slide fastener to the material.

2. Prior Art

Known presser feet of this description typically comprise a sole portion engageable with the tape web of the slide fastener and having a pair of elongated recesses each serving to guide a row of fastener elements carried on one longitudinal edge of the fastener tape, the recesses being separated by a V-shaped partition which extends centrally from the rear to front ends of the presser foot and which is intersected by a through slot accommodating the reciprocating movement therethrough of a sewing machine needle. The bottom or longitudinal edge of the V-shaped partition terminates short of the lower surface of the sole portion. This is intended, coupled with the fact that the element-guide recesses are tilted outwardly away from the vertical axis of the foot, to locate the line of stitching as close as possible to the row of fastener elements; namely, adjacent a folded edge of a concealed fastener tape, thereby concealing the slide fastener from view to maintain the attractive appearance of the garment. With this arrangement, however, when the slide fastener is inserted with its leading selvedge portion held upright into one of the element-guide recesses of the presser foot, the selvedge portion is prone to resume its original posture within the recess because the said portion is dimensionally instable, being devoid of fastener elements, hence relatively thin and narrow. This would make it difficult to maintain the slide fastener in the proper sewing position while it is being advanced and therefore to establish a correct line of stitch, as desired, closely adjacent the row of fastener elements.

This problem is likewise involved in the type of slide fastener which has relatively thin top end stops such as those formed by flattening out the fastener elements.

SUMMARY OF THE INVENTION

Briefly stated, a presser foot according to the invention has a partition disposed longitudinally centrally of the foot, a pair of spaced grooves separated by the partition and means retaining a folded edge of a concealed fastener stringer in unfolded sewing disposition. This means extends both downwardly beyond the lower surface of the partition to register with or project slightly beyond the bottom surface of the foot and laterally beyond both sides of the partition.

An object of the present invention is to provide a presser foot for sewing concealed slide fasteners to a garment or the like, which presser foot has means for retaining the folded edge of a slide fastener stringer in properly unfolded position during the sewing operation and guiding the same so as to locate the stitch line closely adjacent the row of fastener elements.

This and other objects and features of the invention will be better understood from the following detailed description of a preferred embodiment taken in conjunction with the accompanying drawings.

DETAILED DESCRIPTION OF THE PREFERRED EMBODIMENT

Figure 1:
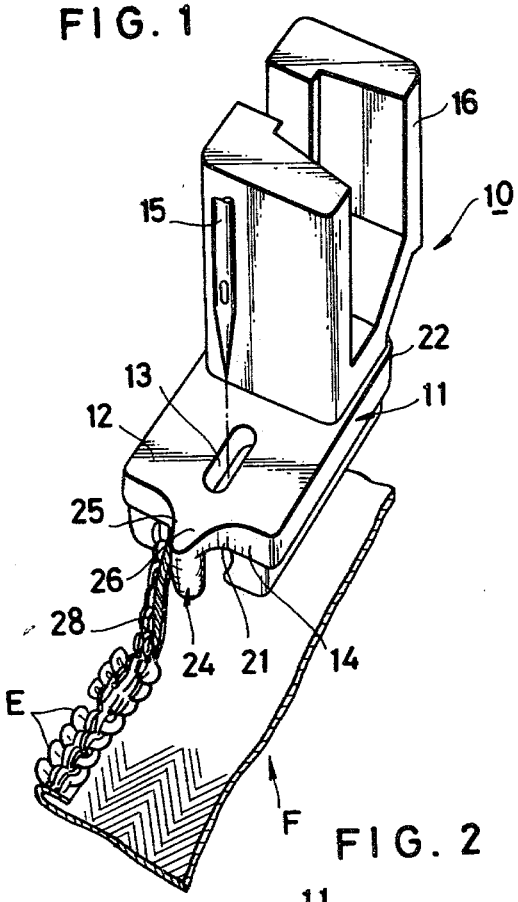
FIG. 1 is a perspective view of a presser foot according to the invention, showing the same applied to a concealed type of slide fastener stringer.
Figure 2:
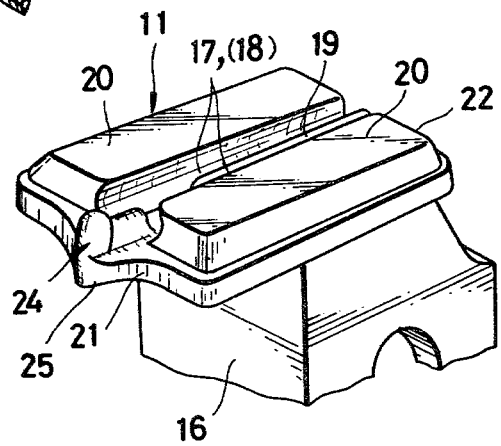
FIG. 2 is a perspective bottom view of the presser foot of FIG. 1.
Figure 3:
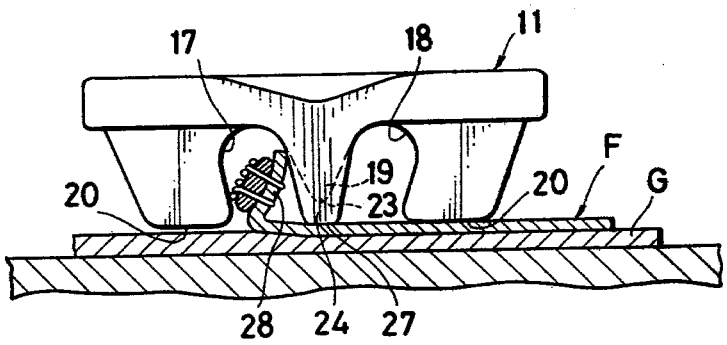
FIG. 3 is a partly sectional end elevation of the presser foot, showing the initial stage of sewing operation in which a folded edge of a fastener stringer devoid of fastener elements is retained in unfolded position.
Figure 4:
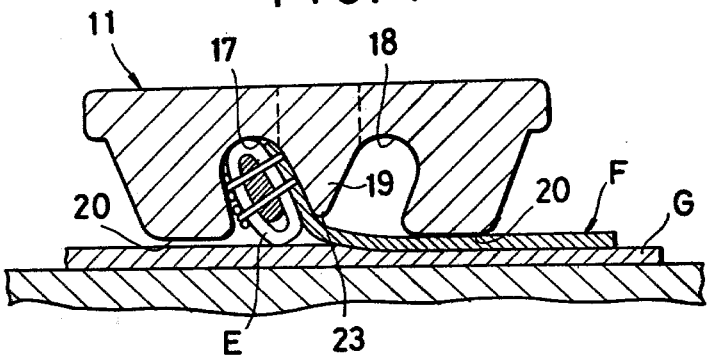
FIG. 4 is a transverse cross-sectional view of the presser foot, showing the fastener stringer being sewn.

Referring now to the drawings and FIG. 1 in particular, there is shown a presser foot provided according to the invention for attachment onto a sewing machine for sewing a slide fastener particularly of a concealed type to a material such as a garment fabric. The presser foot generally designated 10 comprises a plate member 11 having a generally rectangular outline with a substantially flat top surface 12 and with a through slot 13 provided adjacent the forward end 14 of the presser foot 10 for receiving a sewing needle 15. Shown at 16 is a vertical shank adapted to connect the presser foot 10 to a sewing machine not shown. The bottom or sole portion of the foot 10 is hollowed out to form a pair of longitudinal guide grooves 17, 18 separated by a substantially V-shaped partition 19 disposed centrally along the longitudinal axis of the presser foot 10. The guide recesses 17, 18 are tilted outwardly away from the vertical axis of the presser foot 10 so as to permit a fastener stringer F to be sewn closely adjacent a row of fastener element E to a garment fabric G as shown in FIGS. 3 and 4. The sole or bottom surface 20 is flat and smooth so as not to impede relative movement between the presser foot 10 and the fastener stringer F while the latter is being sewn to the garment fabric G. The partition 19 extending from the front end 21 to the rear end 22 has a longitudinal tapered bottom surface 23 which terminates short of the bottom surface 20 of the foot 10. The partition 19 is provided with a projecting lug 24 projecting forwardly beyond the front end 21 and merging with an extension 25 centrally of the presser foot 10 to form a substantially triangular top surface portion 26 as shown in FIG. 1, the arrangement being that the fastener stringer F having a slider (not shown) can be stitched as far and close to the slider as possible because the slider is held in abutting engagement with the projecting lug 24. As better shown in FIGS. 2 and 3, the projecting lug 24 projects downwardly as far as to register with the bottom surface 20 of the foot 10.

While the lug 24 may project slightly beyond the bottom surface 20 for the purpose by the invention, it is most preferable to locate the lowermost end 27 of the lug 24 in surface registration with the bottom surface 20 of the foot 10 as shown in FIG. 3. The lug 24 further projects laterally beyond both sides of the partition 19, as better shown in FIG. 3.

Figure 5:
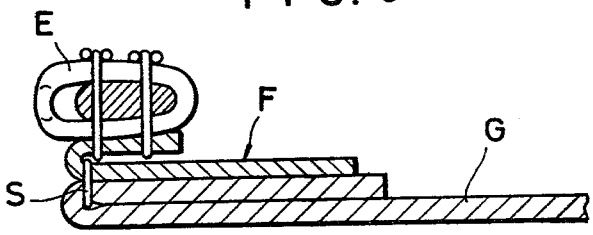
FIG. 5 is a schematic view illustrating the concealed fastener sewn to a garment fabric.

The projecting lug 24 thus formed serves to retain the folded edge 28 of the concealed fastener stringer F which is devoid of fastener elements E in unfolded disposition when inserted into the guide grooves 17,

(18) to commence the sewing operation and thereby prevent the stringer F from getting folded back underneath the partition 19 or from slipping out of the guide grooves 17, (18) during the initial stage of the sewing operation. Once the leading end of the fastener stringer F free of fastener elements E has moved past the projecting lug 24, the stringer F can be advanced while being sewn as at S closely along the row of fastener elements E or the folded edge 28 as shown in FIG. 4 to produce a sewn article such as shown in FIG. 5.

While changes and modifications can be made in the form and construction of the presser foot 10, they should not depart from the scope of the appended claims. An example of such changes and modifications includes forming the projecting lug 24 flush with the front end 21 and flaring or widening the guide grooves 17, 18 at the front end 21 of the foot 10.

Although various minor modifications may be suggested by those versed in the art, it should be understood that I wish to embody within the scope of the patent warranted hereon, all such embodiments as reasonably and properly come within the scope of my contribution to the art. What is claimed is:

1. A presser foot for sewing to garments or the like, the stringer tapes of a slide fastener in which a row of fastener elements is secured to a lengthwise section of a longitudinal folded edge portion of a corresponding stringer tape and a lengthwise section of said tape edge portion is free of fastener elements; which presser foot comprises: a plate member having a generally flat bottom surface which engages, at least in part, the stringer tape; a slot in said plate member extended therethrough for receiving a sewing needle that stitches through the stringer tape, a pair of longitudinal grooves in said plate member and opening at the bottom surface thereof, each groove having an orientation to guide through the presser foot a row of fastener elements secured to the corresponding stringer tape; a partition having a generally V-shaped transverse profile and extending longitudinally between said grooves and in central relation therewith, said partition being interrupted by said slot to define front and rear partition members spaced apart from each other by the distance across said slot, said partition members each having a bottom surface terminating short of the bottom surface of said plate, said front partition member having a surface disposed to engage the stringer tape along the fastener element section of the folded edge portion thereof to position the fastener tape in at least a partially unfolded attitude within one of said grooves, said front partition member having a lug projecting downwardly with the lowermost end thereof lieing substantially in surface registration with the bottom surface of the plate said lug extending laterally beyond both sides of said front partition member, said lug cooperating with the bottom surfaces of said partition members to maintain the stringer tape in guided relation with the presser foot for sewing along a predetermined line with respect to the folded edge portion of the stringer tape, said lug being disposed to engage the stringer tape to maintain the fastener element-free section thereof in a given alignment with respect to the corresponding groove for sewing along said line.

2. A presser foot according to claim 1 wherein said plate member has an extension at its front end and said lug is located on said extension.

* * * * *